US007631958B2

(12) United States Patent
Kanda

(10) Patent No.: US 7,631,958 B2
(45) Date of Patent: Dec. 15, 2009

(54) INK-JET RECORDING HEAD AND INK-JET RECORDING DEVICE

(75) Inventor: Torahiko Kanda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/352,695

(22) Filed: Jan. 13, 2009

(65) Prior Publication Data

US 2009/0122115 A1 May 14, 2009

Related U.S. Application Data

(62) Division of application No. 11/116,789, filed on Apr. 28, 2005, now Pat. No. 7,517,054.

(30) Foreign Application Priority Data

Nov. 5, 2004 (JP) ..... 2004-322343

(51) Int. Cl.
*B41J 2/05* (2006.01)
*B41J 2/045* (2006.01)

(52) U.S. Cl. ..... 347/65; 347/68

(58) Field of Classification Search ..... 347/54, 347/57, 65, 67, 68

See application file for complete search history.

(56) References Cited

U.S. PATENT DOCUMENTS

| | | | |
|---|---|---|---|
| 4,336,544 | A | 6/1982 | Donald et al. |
| 4,520,374 | A | 5/1985 | Koto |
| 5,909,230 | A | 6/1999 | Choi et al. |
| 6,079,813 | A | 6/2000 | Tuli |
| 6,626,525 | B1 | 9/2003 | Nakamura et al. |

FOREIGN PATENT DOCUMENTS

| | | |
|---|---|---|
| JP | 55-017589 | 2/1980 |
| JP | 58-062061 | 4/1983 |
| JP | 58-062062 | 4/1983 |
| JP | 04-138255 | 5/1992 |
| JP | 08-114408 | 5/1996 |
| JP | 08-281939 | 10/1996 |
| JP | 9-327918 | 12/1997 |
| JP | 2000-085118 | 3/2000 |
| JP | 2000-218780 | 8/2000 |
| JP | 2003-34710 | 2/2003 |
| JP | 2003-118114 | 4/2003 |
| JP | 2003-220702 | 8/2003 |

*Primary Examiner*—Stephen D Meier
*Assistant Examiner*—Geoffrey Mruk
(74) *Attorney, Agent, or Firm*—Fildes & Outland, P.C.

(57) ABSTRACT

The present invention provides an ink-jet recording head. The ink-jet recording head includes a nozzle that ejects an ink droplet; an ink flow path member that includes the nozzle; a beam member connected to the ink flow path member or which includes the ink flow path member; a first drive component connected with and set at the beam member and which bends the beam member; and a second drive component that deforms the beam member so as to become convex from concave in the ink droplet discharging direction. The second drive component deforms the beam member so as to become convex from concave in the ink droplet discharging direction and the first drive component bends the beam member. Thereby, the beam member is buckling reverse deformed with the second drive component.

8 Claims, 10 Drawing Sheets

12
20
18

16
1
12
14
30
32

12
20
18

2
16
12
14
30
32

12
20
18

2
16
12
14
30
32

12
20
18

16
1
12
14
30
32

RELATED ART

INK-JET RECORDING HEAD AND INK-JET RECORDING DEVICE

CROSS-REFERENCE TO RELATED APPLICATION

This application is a division of U.S. application Ser. No. 11/116,789 filed Apr. 28, 2005, which claims priority under 35 U.S.C. 119 from Japanese Patent Application No. 2004-322343, the disclosure of which is incorporated by reference herein.

BACKGROUND OF THE INVENTION

1. Field of the Invention

The present invention relates to an ink-jet recording head and an ink-jet recording device.

2. Description of the Related Art

Aqueous ink-jet printers currently available on the market tend to, in principle, use dye inks and pigment inks having viscosities of about 5 cps or, on the high end, about 10 cps. It is known that printing capability can be improved by increasing the ink viscosity in order to: prevent ink from bleeding at the time of impact with the medium; increase optical color density; suppress swelling of the medium by reducing the moisture content; achieve quick-drying features; or obtain a high degree of freedom by completely designing high-quality inks having all of these characteristics.

On the other hand, in order to eject high-viscosity ink, it is necessary to use a mechanism that generates high-output pressure, and this tends to create disadvantages such as increases in cost and head size. Conventionally, a heater is provided separately from the ejector, and a technology is known where the ink viscosity is forcefully lowered at the time of ejecting (e.g., Japanese Patent Application Laid-Open (JP-A) No. 2003-220702 (refer to FIG. 1 and pp. 4 to 6)). Nonetheless, there is a fundamental problem with the aforementioned method in which the ink is heated in that ink deterioration and damage to the duct is accelerated and usable inks are limited to those that do not deteriorate with heat.

Besides the above, a technology has been disclosed where higher viscosity ink is ejected and ink flow in the opposite direction, when discharging the ink, is restrained by a beam-shaped valve (e.g., JP-A No. 9-327918 (refer to FIG. 1 and pp. 8 and 9)).

A technology has been disclosed where buckling bending, by which large deformation can be obtained, is used as a method for increasing the power of the pressure-generating mechanism itself. This technology utilizes a diaphragm-shaped actuator that deforms with the heat-expansion difference with the heat-generating layer (e.g., JP-A No. 2003-118114 (refer to FIG. 3 and pp. 4 and 5)). Further, a technology has been disclosed that uses a cantilevered beam-shaped actuator with a similar configuration (e.g., JP-A No. 2003-34710 (refer to FIG. 13 and pp. 6 to 8)).

An example is shown in FIGS. 10A and 10B of an ink-jet recording head 100 in which an actuator 102 rapidly pressurizes an ink 101 in an ink chamber 106 by deformation (from FIG. 10A to FIG. 10B) whereby the ink is ejected from a nozzle 104 as an ink droplet 108.

Nonetheless, even in the aforementioned related art, it is extremely difficult to stably eject high-viscosity inks, such as those having viscosities greatly larger than 10 cps, i.e., 50 to 100 cps, at ordinary temperature.

In the related art with an ink-jet recording head utilizing an electrostrictive element, it is necessary to use an element provided with rapid rising/falling characteristics in the switching IC. For this reason, these technologies have been extremely expensive.

SUMMARY OF THE INVENTION

The present invention has been made in view of the above circumstances and provides an ink-jet recording head and an ink-jet recording device.

More specifically, the present invention involves an ink-jet recording head utilizing the reverse of the buckling bending direction of a beam, where the discharging (or non-discharging) of ink is controlled by providing (or not providing) bending deformation to a beam in advance with an electrostrictive element. That is, it is controlled by whether a buckling bending reverse is generated while using a low-cost element.

The ink-jet recording head of the first aspect of the present invention has a nozzle that ejects ink droplets; an ink flow path member that includes the nozzle; a beam member that is connected to the ink flow path member or which includes the ink flow path member; a first drive component that is connected with and set at the beam member and which bends the beam member; and a second drive component that deforms the beam member so as to become convex from concave in the ink droplet discharging direction. The second drive component deforms the beam member so as to become convex from concave in the ink droplet discharging direction and the first drive component bends the beam member, whereby the beam member is buckling reverse deformed with the second drive component.

With the first aspect, an ink-jet recording head that can perform control of each ejecting of ink by setting the second drive component, which bends the beam member, and the first drive component, which switches buckling deformation ON/OFF, is provided. This is configured so that many beam members can be bent with just a minimum second drive component and the gradient of the operation control voltage displacement can be moderate so a low-cost switching element can be used.

The ink-jet recording head of the second aspect of the present invention has a nozzle that ejects ink droplets; an ink flow path member that includes the nozzle; a beam member that is connected to the ink flow path member or includes the ink flow path member; a first drive component that is connected and set at the beam member and makes the beam member bend; and a second drive component that deforms the beam member to become convex from concave in the ink discharging direction. The second drive component deforms the beam member so as to become convex from concave in the ink droplet discharging direction and the first drive component bends the beam member, whereby the beam member is not buckling reverse deformed with the second drive component.

In the second aspect, it is possible to perform control of each ejecting of ink by setting the second drive component, which bends the beam member, and the first drive component, which switches buckling deformation ON/OFF. Further, this is configured so that many beam members can be bent with just a minimum second drive component, each operation performed with the first drive component, and the gradient of the operation control voltage displacement can be moderate so a low-cost switching element can be used.

The ink-jet recording device of the third aspect of the present invention includes the ink-jet recording head of the first aspect or the second aspect.

The third aspect includes the ink-jet recording head of the first embodiment or the second embodiment so it can eject high-viscosity ink on a recording medium, and in comparison with the ink-jet printing devices of the related art, it is possible to perform superior high-quality recording without blur.

As discussed above, the ink-jet recording head and ink-jet recording device of the present invention can eject high-viscosity ink at ordinary temperature.

BRIEF DESCRIPTION OF THE DRAWINGS

Preferred embodiments of the present invention will be described in detail based on the following drawings, wherein:

FIGS. 4A to 4F are drawings showing the operation of an ink-jet recording head of the first embodiment of the present invention;

DETAILED DESCRIPTION OF THE INVENTION

Figure 1A:
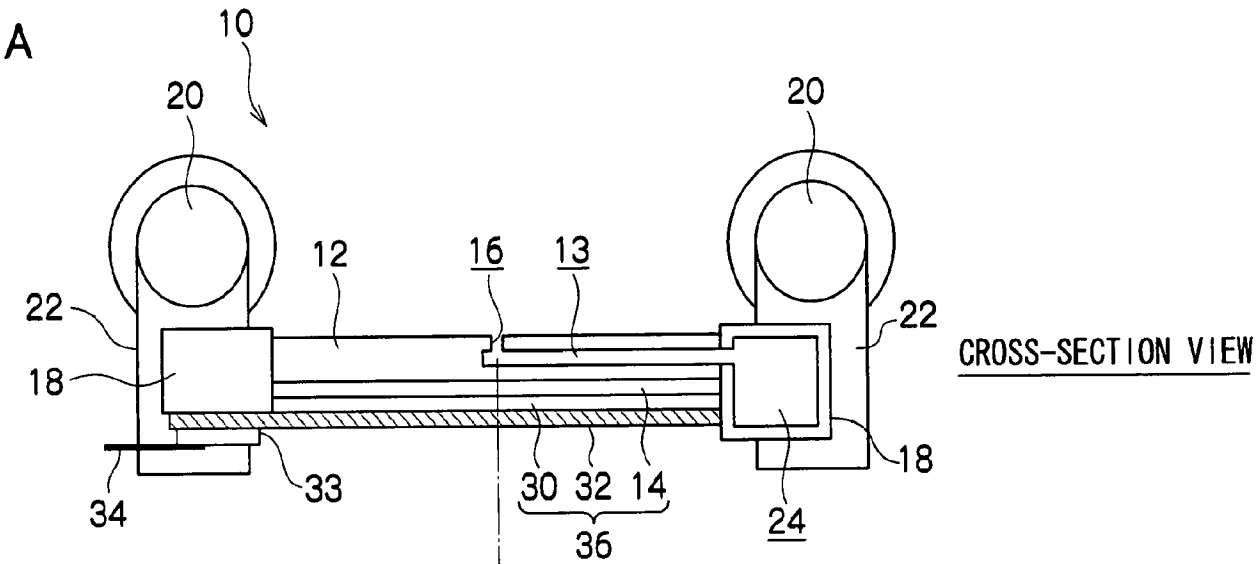
FIGS. 1A and 1B are drawings showing an ink-jet recording head of the first embodiment of the present invention.
Figure 1B:
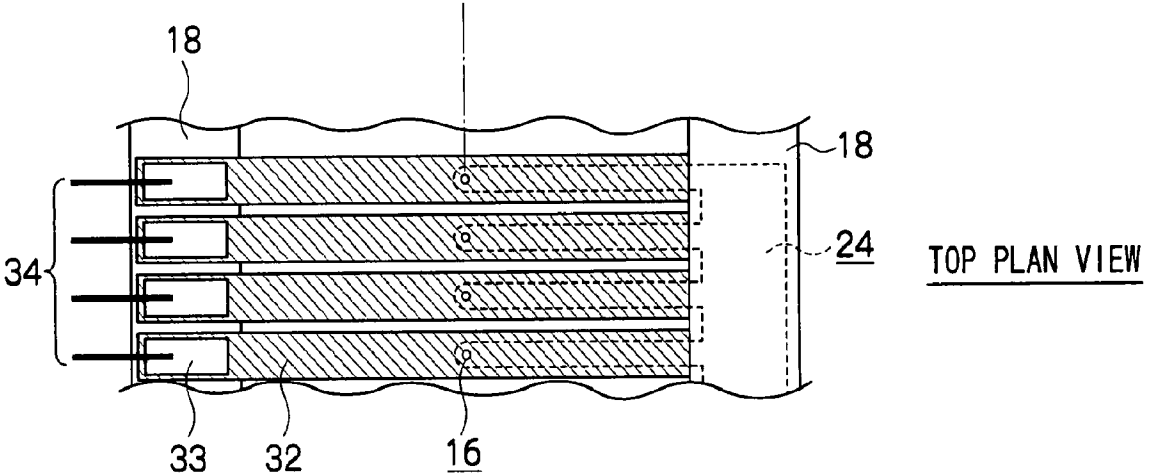

An ink-jet recording head of the first embodiment of the present invention is shown in FIGS. 1A and 1B.

As shown in FIGS. 1A and 1B, an ink-jet recording head 10 constitutes an ink flow path member 12, which is provided with an ink flow path 13 in its interior having a nozzle 16 set approximately in the center in the lengthwise direction, and a beam member 14 that supports the ink flow path member 12 and is connected at both ends with retaining components 18.

A piezo element 30 is joined with the beam member 14 and a signal electrode 32 is further formed at the piezo element 30, whereby the actuator 36 comprises the beam member 14, piezo element 30, and signal electrode 32. The beam member 14 doubles as the common electrode of the piezo element 30 and is structured so that the piezo element 30 is sandwiched by the beam member 14 and the signal electrode 32. An electrode pad 33 is set at one end of the signal electrode 32 and connected to the switching IC by signal wiring 34. The piezo element 30 is driven by signals from this switching IC and performs control of making (or not making) the beam member 14 bend.

The ink flow path member 12 is bendable in the ink discharging direction (at the top of the drawing) and in the opposite direction. The ink (provided from an ink pool 24) that passes through the ink flow path 13 reaches the nozzle 16 and is ejected by inertia in the discharging direction as ink droplets.

As previously discussed, the ink used here is a high-viscosity ink (i.e., with extremely high ink viscosity, specifically, a viscosity that is much higher than 10 cps (e.g., 50 to 100 cps)) used in order to: prevent ink blur at the time of impact with the medium; increase optical color density; suppress swelling of the medium by reducing the moisture content; achieve quick drying features; or obtain a high degree of freedom by completely designing high-quality inks having all of these characteristics.

The retaining component 18 is fixed to an arm 22 that is set to a rotary encoder 20 and set at a position that is offset from the center of rotation of the rotary encoder 20 only of the portion of the length of the arm 22 and pressed from both sides; or bends the ink flow path member 12 connected to the beam member 14 by adding force in the bending direction and bending in the ink discharging direction or the opposite direction.

As shown in FIG. 1B, the retaining component 18 can be configured such that a ladder structure with multiple ink flow path members 12 is set at the retaining component 18.

The actual operation will be explained below.

The operation of the ink-jet recording head of the first embodiment of the present invention is shown in FIGS. 2A to 2E and FIGS. 3A to 3E.

Figures 2A, 2B, 2C, 2D, 2E:
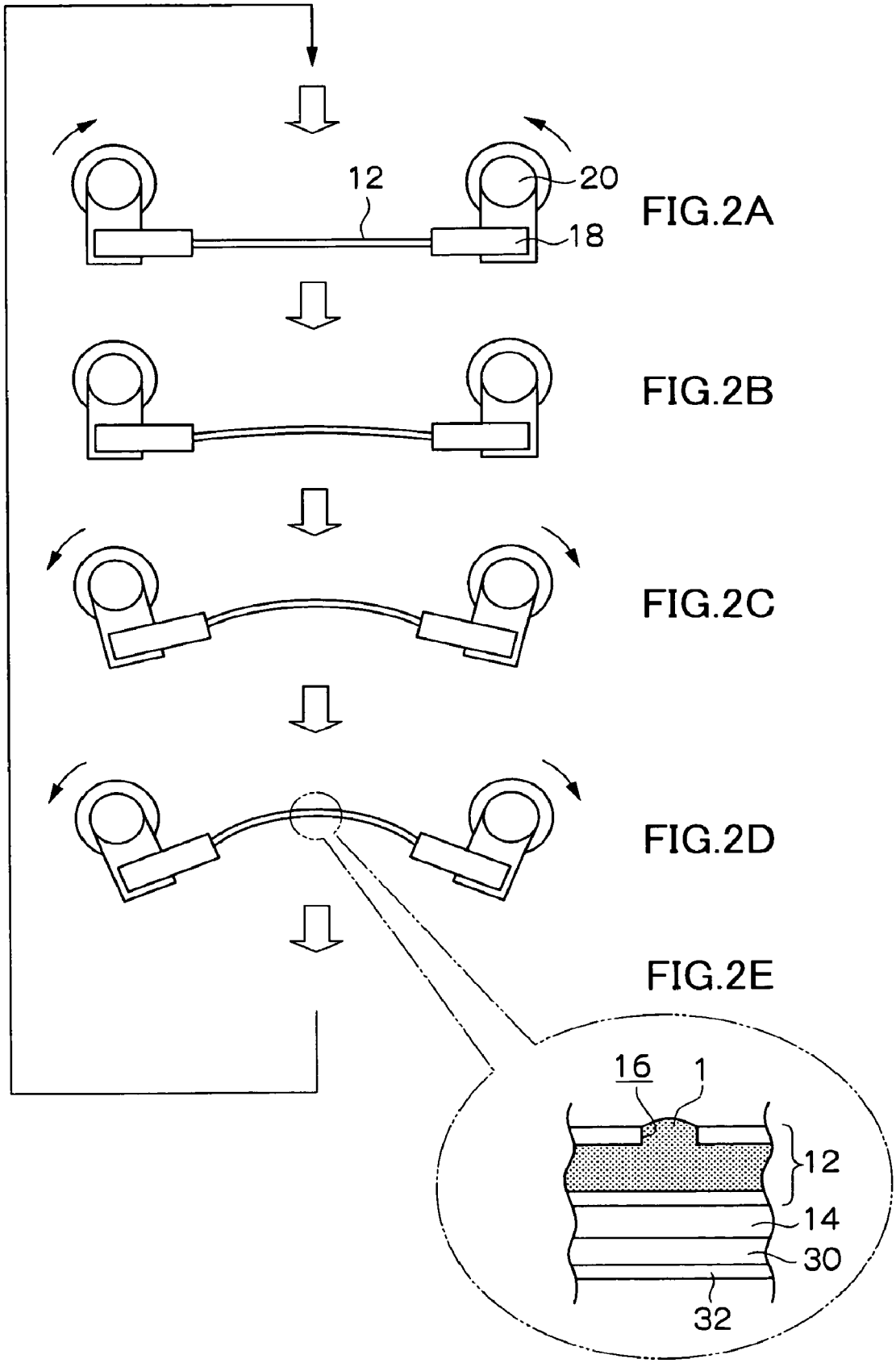
FIGS. 2A to 2E are drawings showing the operation of an ink-jet recording head of the first embodiment of the present invention.

As shown in FIG. 2B, the ink flow path member 12 is in a state where it is made to hold a bend in the ink discharging direction (in the drawing, at the top) in advance and in a case where a signal instructing to eject is not sent by the switching IC, the actuator 36 is not driven and, as shown in FIG. 2C, turns the rotary encoders 20 in the directions of the arrows and, as shown in FIGS. 2C and 2D, the ink flow path member 12 bends only in the ink discharging direction. The ink flow path member 12 is continuously convex in the ink discharging direction until it reaches the maximum amount of bending shown in FIG. 2D.

That is, until the displacement shown from FIG. 2B to FIG. 2D is achieved, sufficient acceleration is not given to the ink 1 in the interior of the ink flow path member 12, so it is not ejected from the nozzle 16 as an ink droplet (enlarged drawing FIG. 2E).

Further, the amount of bending is at its maximum in FIG. 2D, and after the rotary encoders 20 stop, they rotate oppositely making the ink flow path member 12 flat and even (FIG. 2A) whereby the ink flow path member 12 returns to the beginning position of FIG. 2B.

Figures 3A, 3B, 3C, 3D, 3E:
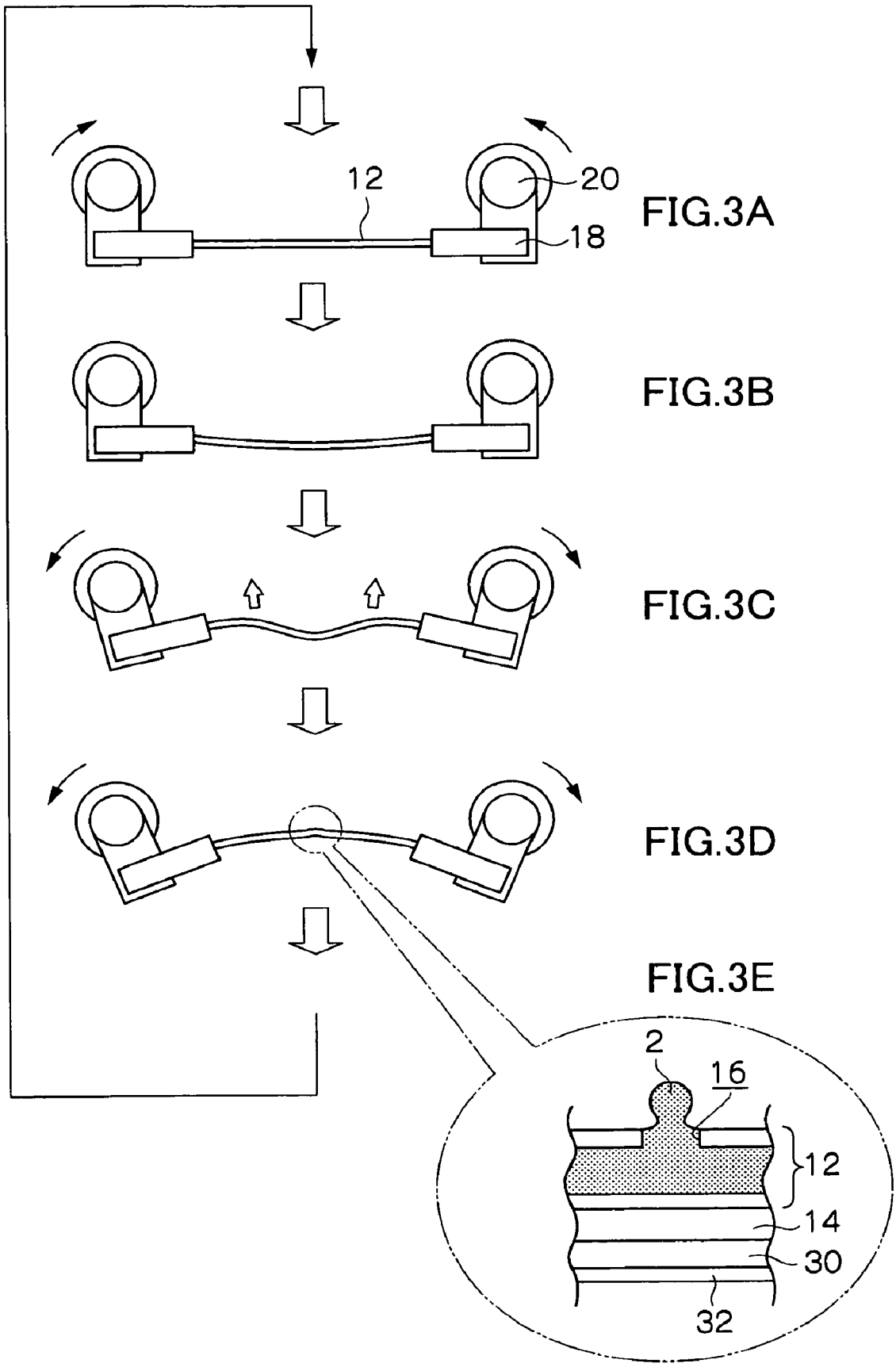
FIGS. 3A to 3E are drawings showing the operation of an ink-jet recording head of the first embodiment of the present invention.
Figure 4F:
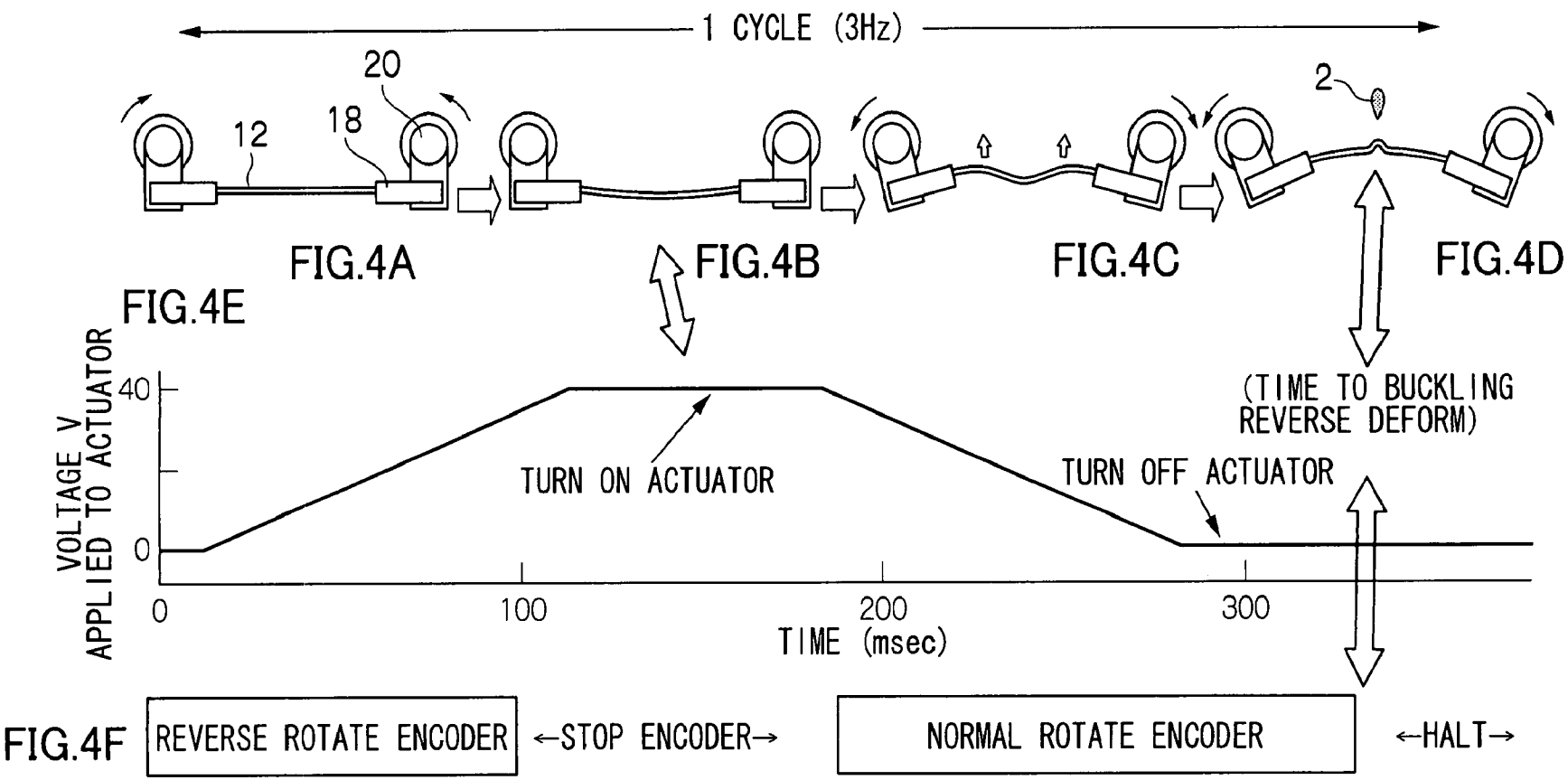

Meanwhile, as shown in FIG. 3B, a signal instructing to eject is sent by the switching IC and the ink flow path member 12 is in a state where it is made to hold a bend concavely relative to the ink discharging direction (the underneath portion shown in the drawing) by the actuator 36 being driven and, as shown in FIG. 3C, the rotary encoders 20 are made to rotate normally (in the directions of the arrows in the drawings) whereby the bending direction of the ink flow path member 12 changes to be convex in the ink discharging direction. In other words, the areas close to the rotary encoders 20 gradually bend from both ends.

When this change approaches the center from both ends, the ink flow path member 12 (or the beam member 14) starts a precipitous buckling reverse at a certain point and rapidly deforms in the ink discharging direction (in the drawing, towards the top). (FIG. 3D shows emphasis of the deformation of the central portion.)

Since the nozzle 16 is set approximately in the center of the lengthwise direction of the ink flow path member 12, the ink 1, which reaches the nozzle 16, is ejected as an ink droplet 2 from the nozzle 16 (enlarged drawing FIG. 3E) with the deformation of the ink flow path member 12 in the discharging direction caused by this buckling reverse.

Further, the amount of bending reaches its maximum in FIG. 3D and after the rotary encoder 20 stops, it rotates oppositely making the ink flow path member 12 flat (FIG. 3A) whereby the ink flow path member 12 returns to the beginning position and to a state holding the bend at the top in the ink discharging direction of FIG. 2B.

The speed of deformation due to this buckling reverse is, when compared to displacement by a common actuator and the like, is extremely great so that even if the ink is the high-viscosity ink employed in the present invention, it is possible to sufficiently eject it as an ink droplet 2.

The relation between the displacement of the ink flow path member 12 (beam member 14) occurring between FIGS. 3A to 3D and the discharging of the ink droplet 2 is shown in FIGS. 4A to 4F.

FIGS. 4A to 4F show the operation of the ink-jet recording head 10, from directly before the ink flow path member 12 starts the buckling reverse until directly after discharging of the ink droplet, the voltage applied to the actuator 36, and the change due to the time of operation of the rotary encoder 20.

In FIG. 4A, the rotary encoders 20 are driven to reverse (i.e., in the directions pulling both ends of the ink flow path member 12) and stretch the ink flow path member 12 by pressing and by returning it to the beginning state and the ink flow path member 12 reverts to the state where it was given the beginning bend (in this case, the discharging direction: the convex portion in the upper part of the drawing).

Next, the rotary encoders 20 stop in FIG. 4B and a signal instructing to eject is sent by the switching IC at about this timing and when the actuator 36 is driven, the ink flow path member 12 concaves in the discharging direction. This deformation, an example of which is shown in the graph of application of voltage/change in time, is driven at a very moderate rising waveform of about 1 V/msec or less. Further, it is not necessary to provide the waveform itself with a precipitous peak and it can be a waveform with an accentuated angle. Accordingly, it is not necessary to use an expensive switching IC.

The deformation by the actuator 36 is completed and when the ink flow path member 12 reaches a regulated amount of bending, as shown in FIG. 4C, the rotary encoders 20 are driven to normal rotation (i.e., in the directions in which both ends of the ink flow path member 12 are pressed) and the ink flow path member 12 changes closer to the rotary encoders 20. That is, it changes by becoming convex in the bending direction (gradually from both ends towards the discharging direction, shown at the top of the drawing). At this point, the actuator 36 is turned off but this rising is also characterized in that it is a moderate waveform.

When the bending change of the ink flow path member 12 approaches from both ends towards the center, the ink flow path member 12 (or the beam member 14) starts a precipitous buckling reverse (FIG. 4D) and rapidly deforms towards the ink discharging direction (at the top of the drawing).

At this time, the ink of the interior of the ink flow path member 12 begins to proceed in the discharging direction with uniform velocity caused by inertia and the like so the ink droplet 2 protrudes from the nozzle 16 due to the difference in speeds between the ink flow path member 12 (or the beam member 14) and the ink. When the deformation of the beam member 14 reaches the maximum amount, the displacement in the discharging direction stops so only the ink droplet 2 protrudes from the nozzle 16 (FIG. 4D) and, as is, the ink droplet 2 is shot out in the discharging direction due to inertia.

Here the rotary encoders 20 stop and the next cycle is prepared for. This series of operations, in FIGS. 4A to 4F, was explained with an example when driven at about 1/3 seconds per cycle (3 Hz) with the signal voltage to the actuator 36 at about 40V at its greatest, however, the displacement due to the buckling reverse occurs during a short period of time so with the present invention, extremely favorable discharging characteristics can be obtained, despite the viscosity of the ink being high.

Specifically, the beam member 14 uses a 20 μm-thick SUS plate with a beam having a length of 10 mm, and the ink flow path member 12 uses 50 μm-thick resin film. After patterning the ink flow path 13 with a photolithographic method, the ink flow path member 12 is laminated and connected with the beam member 14. The width after etching removal of the ink flow path 13 is 50 μm. Next, a sputtered electrode is formed on the 30 μm-thick film piezo element 30, connected to the beam member 14, and span separation is performed by dicing.

The nozzle 16 uses laser processing on a polyimide film with a thickness of 25 μm and holes with diameters 30 μm are opened with hole-punching processing. An epoxy-type adhesive is used to connect between the films, which are further connected with an epoxy-type adhesive to the retaining component 18 produced from a rigid body. The rotary encoders 20 and the retaining component 18 are connected in a state such that the retaining component 18 is made to be offset from the center of rotation of the rotary encoder 20 by 2.5 mm and when the ink droplet 2 is ejected (i.e., when making the beam buckle reverse) the rotary encoders 20 are made to turn 20°. The central portion of the beam member 14 moves about 1 mm in the ink discharging direction at a speed of approximately 10 m/s.

Under the above conditions, the mixture ratio of glycerin was increased and an ink whose viscosity was adjusted to 50 cps was ejected and, upon observation with a stroboscopic method of the discharging of the ink droplet 2, it was known that the ink droplet 2 became an ink droplet with a diameter of approximately 25 μm. With an ink of a viscosity of 100 cps, an ink droplet 2 with a diameter of approximately of 20 μm ejected from the nozzle 16. With the above example, the discharging cycle was driven with 3 Hz, however, a slightly small droplet was obtained with 100 cps.

Due to the above-described configuration, the present invention makes it possible to eject, on-demand, high-viscosity ink of 50 cps to 100 cps at ordinary temperature. This was extremely difficult to achieve with the related art.

Unlike the publicly-known conventional piezo drives and thermal drive discharging systems, only a slight bend is generated with the actuator 36 (first drive component) so large displacement is not necessary. Further, the control voltage displacement can be a moderate inclination (e.g., with a rising time of 20 msec or more) and the waveform can have an accentuated angle. Due to this, the load placed on the switching element (momentary current/permissible resistance) can be greatly alleviated so the cost of parts can be reduced.

An ink-jet recording head of the second embodiment of the present invention is shown in FIGS. 5A to 5E and 6A to 6E.

In the second embodiment, the signal sent from the switching IC to the actuator 36 does not eject the ink droplet 2, rather, it is a signal that instructs ejecting incapacitation. The ink droplet 2 is ejected when the signal that instructs ejecting incapacitation is not sent by the switching IC, that is, when the actuator 36 is not driven.

Figures 5A, 5B, 5C, 5D, 5E:
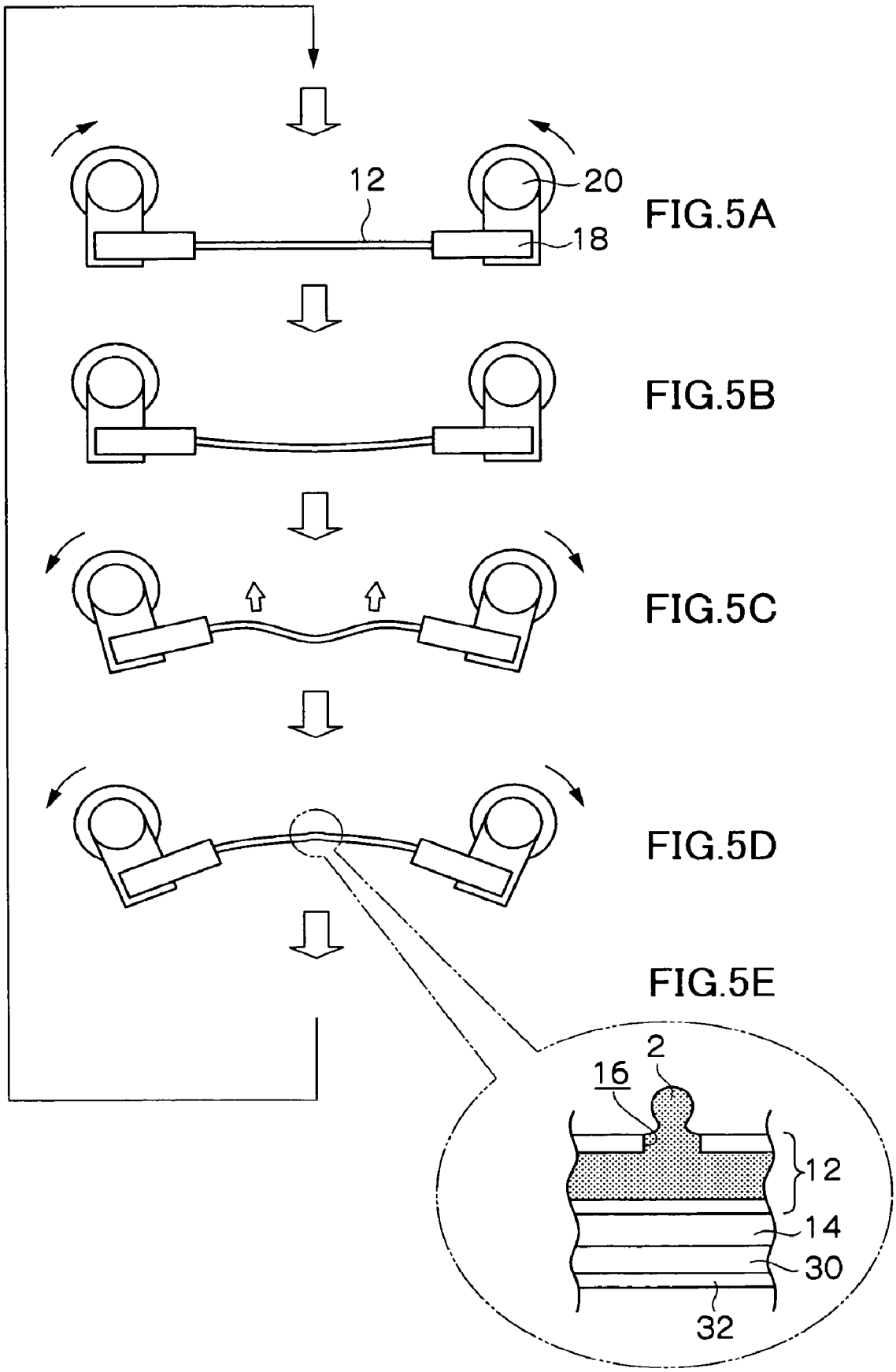
FIGS. 5A to 5E are drawings showing the operation of an ink-jet recording head of the second embodiment of the present invention.

As shown in FIG. 5B, unlike with the first embodiment, the ink flow path member 12 is in a state where it is made to hold a bend in advance (in the underneath portion shown in the drawing) in the direction opposite from the ink discharging direction, and when the signal that instructs ejecting incapacitation is not sent by the switching IC, the actuator 36 is not driven and it remains in a shape concave to the discharging direction and, as is, receives pressing and deformation from the rotary encoders 20.

Next, as shown in FIG. 5C, the rotary encoders 20 are rotated in the directions of the arrows, whereby the parts of the ink flow path member 12 close to the rotary encoders 20 change, i.e., changing from both ends gradually in the bending direction convex to the discharging direction (towards the top of the drawing).

When this change nears the center from both ends, the ink flow path member 12 (or the beam member 14) starts a precipitous buckling reverse at a certain point and rapidly deforms in the ink discharging direction (towards the top in the drawing). (FIG. 5D shows emphasis of the deformation of the central portion.)

Since the nozzle 16 is set approximately in the center of the lengthwise direction of the ink flow path member 12, the ink 1, which reaches the nozzle 16, is ejected as an ink droplet 2 from the nozzle 16 (enlarged drawing FIG. 5E) with the deformation of the ink flow path member 12 in the discharging direction caused by this buckling reverse.

Further, the amount of bending reaches its maximum in FIG. 5D and after the rotary encoders 20 stop, they rotate oppositely making the ink flow path member 12 flat (FIG. 5A) whereby the ink flow path member 12 returns to the beginning position in FIG. 5B.

Figures 6A, 6B, 6C, 6D, 6E:
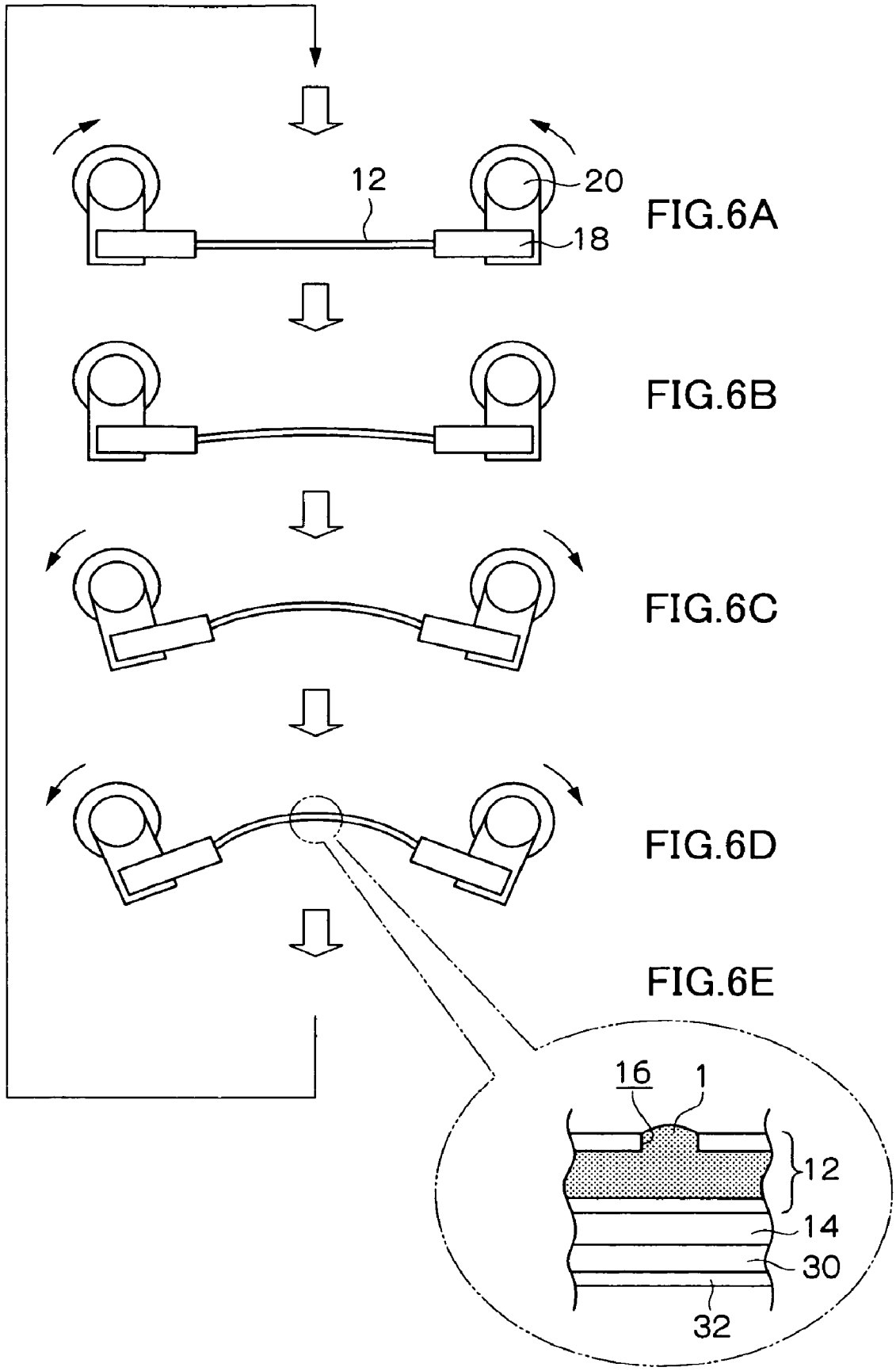
FIGS. 6A to 6E are drawings showing the operation of an ink-jet recording head of the second embodiment of the present invention.

Meanwhile, as shown in FIG. 6B, a signal instructing to eject is sent by the switching IC and the ink flow path member 12 is in a state where it is made to hold a bend convexly relative to the ink discharging direction (towards the top of the drawing) by the actuator 36 being driven and, as shown in FIG. 6C, the rotary encoders 20 are made to rotate normally (in the directions of the arrows) whereby the ink flow path member 12 bends only in the ink discharging direction. As shown in FIG. 6D, the ink flow path member 12 reaches the maximum amount of bending and is continuously convex in the ink discharging direction.

That is, until the displacement shown from FIG. 6B to FIG. 6D, sufficient acceleration is not given to the ink 1 in the interior of the ink flow path member 12, so it is not ejected from the nozzle 16 as an ink droplet (enlarged drawing FIG. 6E).

Further, the amount of bending is at its maximum in FIG. 6D and after the rotary encoders 20 stop, they rotate oppositely making the ink flow path member 12 flat (FIG. 6A) whereby the ink flow path member 12 returns to the beginning position and to the state where it holds a bend in the direction opposite to the ink discharging direction (FIG. 5B).

As in the first embodiment, the speed of deformation due to this buckling reverse, when compared to the displacement by a common actuator and the like, is extremely great so that even if the ink is the high-viscosity ink employed in the present invention, it is possible to sufficiently eject it as an ink droplet 2.

Figure 7A:
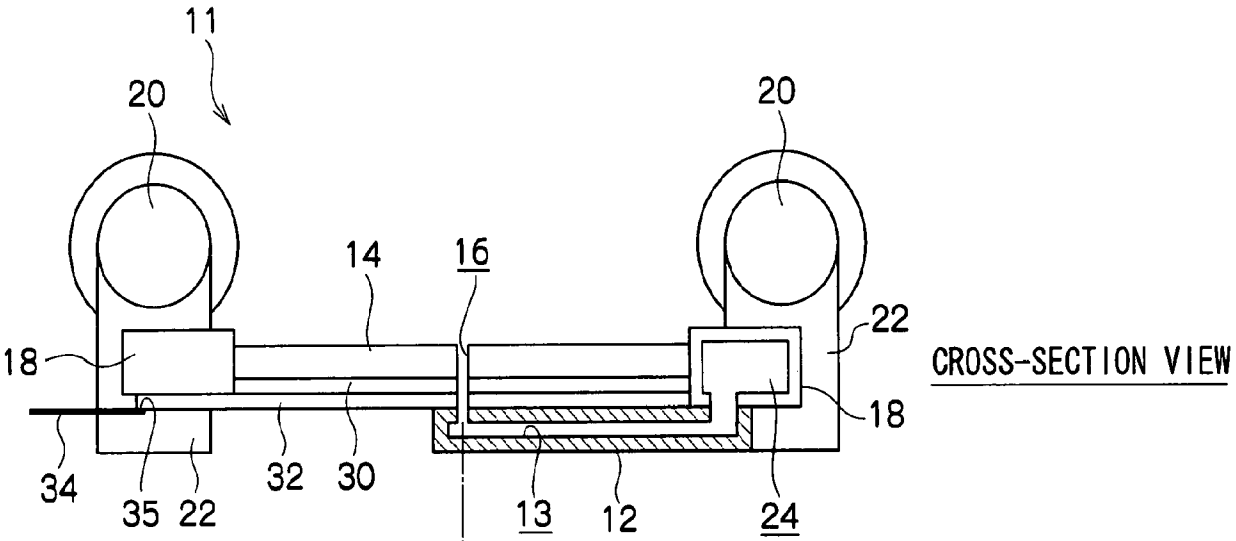
FIGS. 7A and 7B are drawings showing an ink-jet recording head of the third embodiment of the present invention.
Figure 7B:
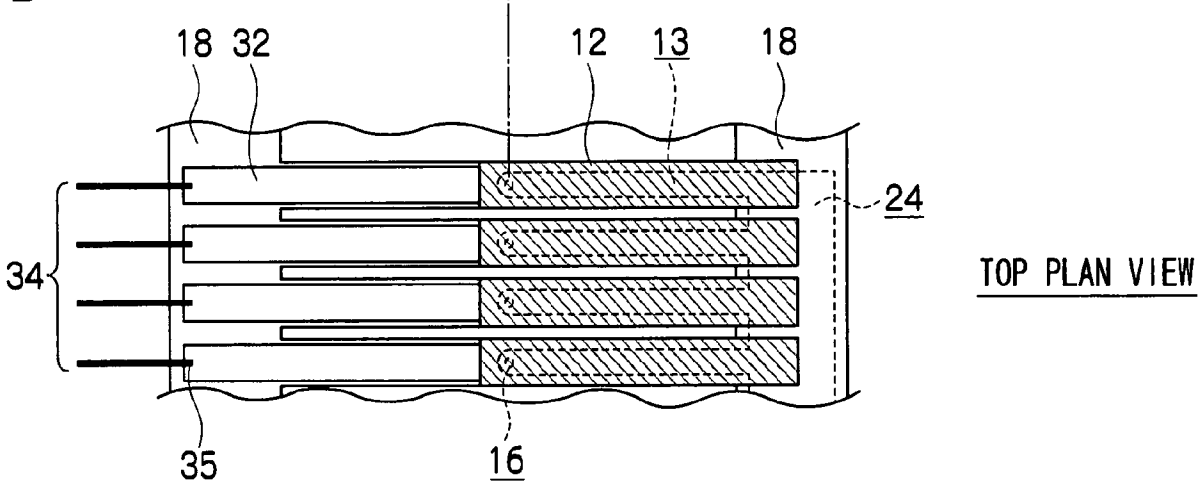

An ink-jet recording head of the third embodiment of the present invention is shown in FIGS. 7A and 7B.

As shown in FIGS. 7A and 7B, an ink-jet recording head 11 constitutes an ink flow path member 12, which is provided with an ink flow path 13 in its interior having a nozzle 16 set approximately in the center in the lengthwise direction, and a beam member 14 that supports the ink flow path member 12 connected at both ends with retaining components 18.

A thin film piezo element 30 is connected with the beam member 14 and a signal electrode 32 is further connected to the piezo element 30, whereby the actuator 36 constitutes the beam member 14, piezo element 30, and signal electrode 32. The beam member 14 doubles as a common electrode of the piezo element 30 and is structured so that the piezo element 30 is sandwiched by the beam member 14 and the signal electrode 32. An electrode pad 35 is set at one end of the signal electrode 32 and connected to the switching IC by signal wiring 34. The piezo element 30 is driven by signals from this switching IC and performs control of making (or not making) the beam member 14 bend.

The ink flow path member 12 is bendable in the ink discharging direction (towards the top of the drawing) and in the opposite direction. The ink (provided from an ink pool 24) that passes through the ink flow path 13 reaches the nozzle 16 and is ejected by inertia in the discharging direction as ink droplets. A hole is set that passes from the ink flow path 13 to the nozzle 16 through the signal electrode 32, piezo element 30, and beam member 14.

Further, in the present embodiment, the ink flow path member 12 is arranged at the rear side of the discharging surface and constitutes a part of the discharging surface having the nozzle 16 set therein with the high-strength beam member 14. Due to this, even if the discharging surface is wiped during head maintenance and the like, the ink flow path 13 and the nozzle 16 are difficult to crush because it is configured with a strong beam member 14 and is thus strong to external force.

Figure 8A:
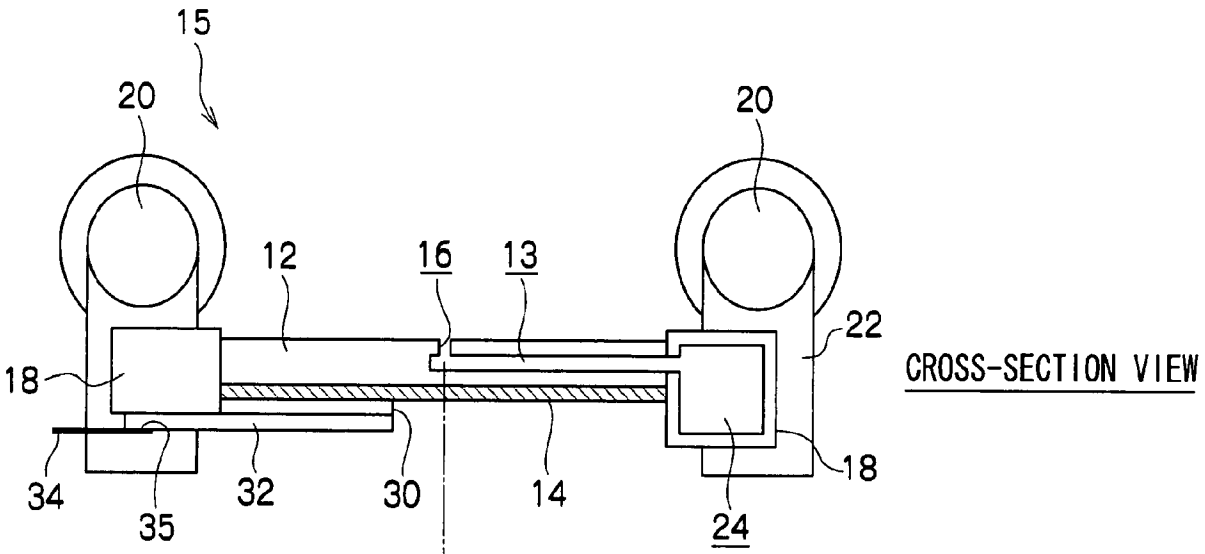
FIGS. 8A and 8B are drawings showing an ink-jet recording head of the fourth embodiment of the present invention.
Figure 8B:
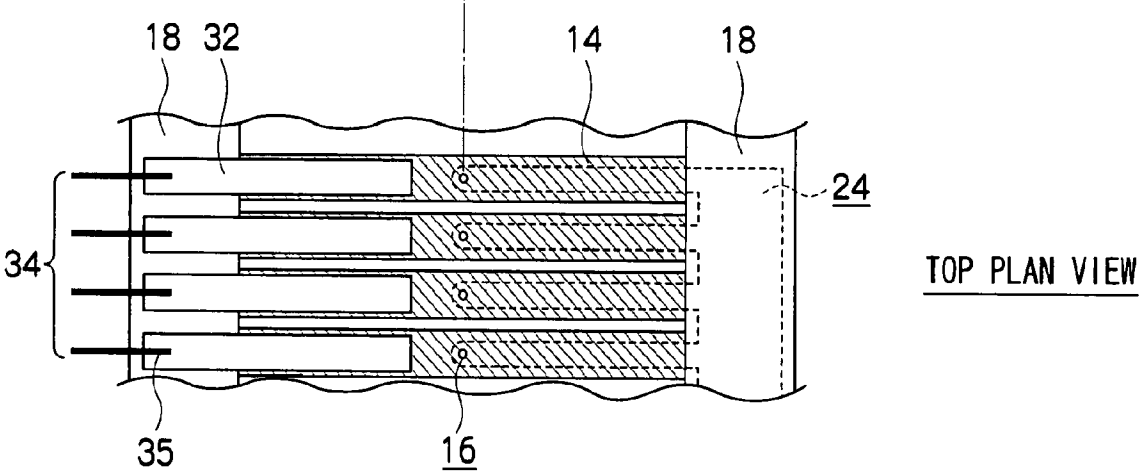

An ink-jet recording head of the fourth embodiment of the present invention is shown in FIGS. 8A and 8B.

As shown in FIGS. 8A and 8B, an ink-jet recording head 15 constitutes an ink flow path member 12, which is provided with an ink flow path 13 in its interior having a nozzle 16 set approximately in the center in the lengthwise direction, and a beam member 14 that supports the ink flow path member 12 connected at both ends with retaining components 18.

A thin film piezo element 30 is connected with the beam member 14 up until approximately the center in the lengthwise direction and a signal electrode 32 is further connected to the piezo element 30, whereby the actuator 36 constitutes the beam member 14, piezo element 30, and signal electrode 32. The beam member 14 doubles as a common electrode of the piezo element 30 and is structured so that the piezo element 30 is sandwiched by the beam member 14 and the signal electrode 32. An electrode pad 35 is set at one end of the signal electrode 32 and connected to the switching IC by signal wiring 34. The piezo element 30 is driven by signals from this switching IC and performs control of making (or not making) the beam member 14 bend.

In the present embodiment, when a sintered ceramic piezo element is used for the piezo element 30, this cannot withstand large buckling bend deformation since it is brittle and breaks. For this reason, this embodiment has the piezo element 30 set at one end side of the beam only.

At this time, the ink flow path member 12 has low rigidity and the actuator 36 bends and deforms with the action of the cantilevered piezo element 30. In comparison with the amount of bending when both ends are fixed, the amount of deformation is great since it is arranged at one side of the beam member 14, and the reverse of the buckling bending direction (i.e., discharging or not discharging of ink) can be controlled with certainty.

Further, the signal electrode 32 employs a metal film formed with a sputtering method or the like. This method can be selected from methods using solder joining and anisotropic conductive adhesive and the like. Accordingly, a connection can be produced from the electrode pad 35 to the signal wiring 34 without setting the electrode pad 33 of the first embodiment.

Figure 9:
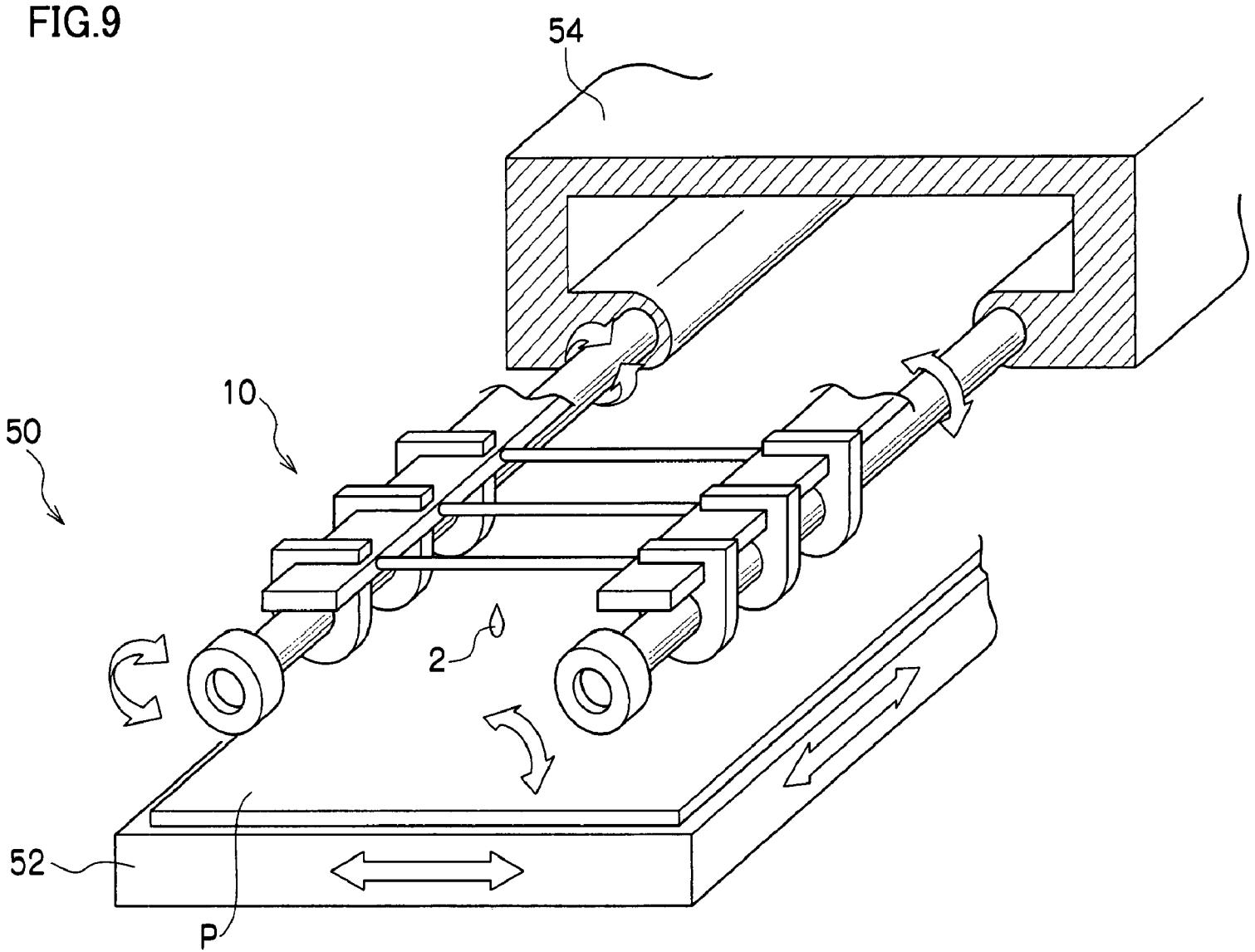
FIG. 9 is a drawing showing an ink-jet recording device of the present invention.
Figure 10A:
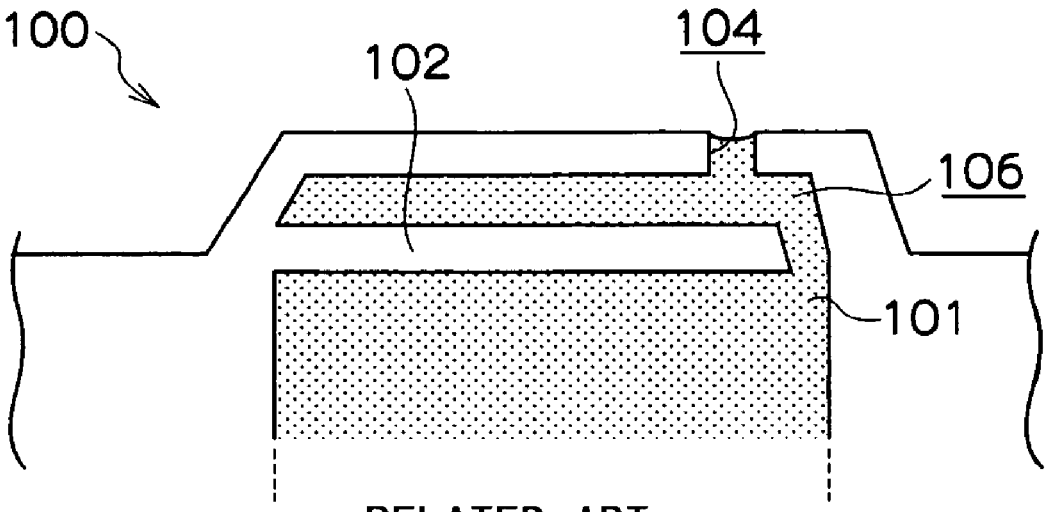
FIGS. 10A and 10B are drawings showing ink-jet recording heads of the related art.
Figure 10B:
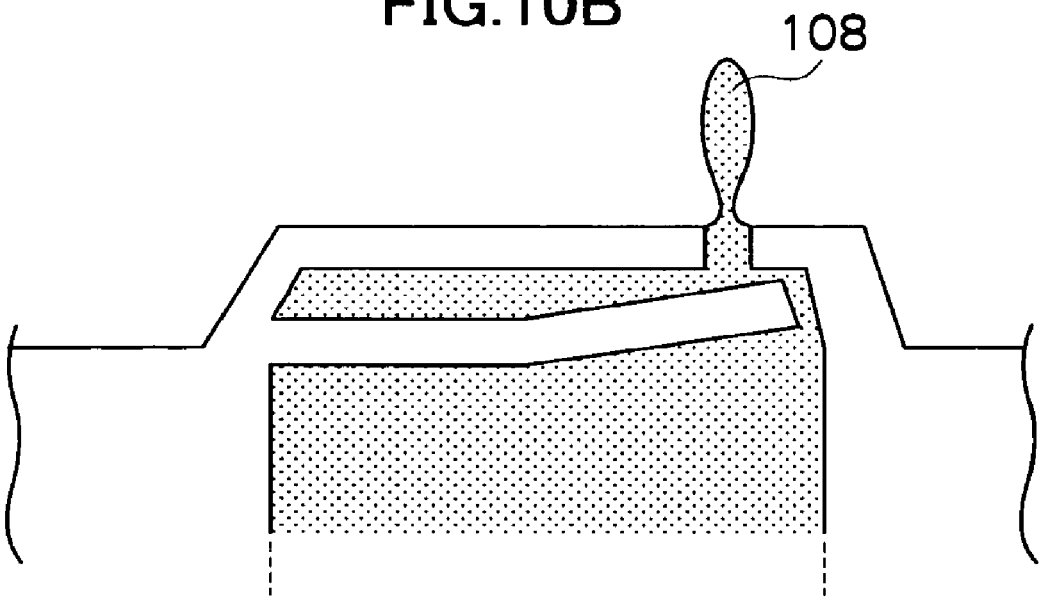
RELATED ART FIG.10B

An ink-jet recording device using the ink-jet recording head of the present invention is shown in FIG. 9.

As shown in FIG. 9, the ink-jet recording device 50 has a head supporting member 54 and the ink-jet recording head 10, 11 or 15 of the present invention is retained thereby. The head supporting member 54 retains the ink-jet recording head 10, 11 or 15 and is structured so as to not hinder the ink discharging operation. A recording media P is mounted underneath the head supporting member 54 and a table 52 that retains it is set.

The recording media P is set on the table 52 and the table 52 is moved within a planar surface in X and Y directions (white arrows in the drawing) while the ink-jet recording head 10, 11 or 15 is driven and an ink droplet 2 of high-viscosity ink is ejected. As discussed previously, blur of the ink droplet 2 upon impact with the recording medium P can be prevented due to the use of high-viscosity ink and high-quality recording can be performed.

It should be noted that the present invention is not limited to the above-described embodiments.

For example, in the above-described embodiments, the actuator is made up from the piezo element 30 and the beam member 14, however, a heat-generating resistance body can be used in place of the piezo element 30, or the actuator can be one that bends and deforms with the heat-expansion difference. It can also be a device utilizing static electricity or magnetic energy, or it can be an actuator having another type of form.

Further, in the above-described embodiments, the nozzle 16 and the ink flow path 13 are formed separately of resin film and adhered and connected, but these are not thus limited. For example, the ink providing duct and the nozzle can be formed uniformly or the beam member 14 can further be structured uniformly, or this can take another form.

Moreover, in the above-described embodiments, the ink-jet recording head 10, 11 or 15 is fixed and recording is performed while moving the recording medium P. Nonetheless, the recording medium P can be fixed and recording can be performed by carrying the ink-jet recording head 10, 11 or 15 mounted on a carriage, or recording can be carried out while moving both. A structure where the recording medium P is wound around a drum and rotated is also possible.

Further, ink-jet recording in the present invention is not limited to the recording of characters or images on recording paper. In other words, the recording medium is not limited to paper and the ejected liquid is not limited to ink. For example, ink can be ejected on a polymer film or glass in order to produce a color filter for use with displays, or liquid solder can be ejected on a base material in order to form bumps for component mounting and the like. In fact, it is possible to use the present invention in all industrial liquid-injection devices.

As disclosed above, the ink-jet recording head of the first aspect of the present invention has a nozzle that ejects ink droplets; an ink flow path member that includes the nozzle; a beam member that is connected to the ink flow path member or which includes the ink flow path member; a first drive component that is connected with and set at the beam member and which bends the beam member; and a second drive component that deforms the beam member so as to become convex from concave in the ink droplet discharging direction. The second drive component deforms the beam member so as to component bends the beam member, whereby the beam member is buckling reverse deformed with the second drive component.

In the ink-jet recording head of the first aspect, the beam member is provided with a beginning bend in advance so as to be convex in the drop discharging direction. By the first drive component bending the beam member to be concave in the ink droplet discharging direction, the second drive component makes the beam member buckling reverse so as to deform from concave to convex in the ink droplet discharging direction.

Due to this, it is provided with a beginning bend so as to be convex towards the discharging direction. The first drive component bends only the beam member so as to be concave in the discharging direction and buckling reverse with deformation is started by the second drive component. The ink droplet is made to disengage with inertia and eject from the nozzle so it is possible to stably control ejecting by the ON/OFF of the first drive component.

The ink-jet recording head of the second aspect of the present invention has a nozzle that ejects ink droplets; an ink flow path member that includes the nozzle; a beam member that is connected to the ink flow path member or includes the ink flow path member; a first drive component that is connected and set at the beam member and makes the beam member bend; and a second drive component that deforms the beam member to become convex from concave in the ink discharging direction. The second drive component deforms the beam member so as to become convex from concave in the ink droplet discharging direction and the first drive component bends the beam member, whereby the beam member is not buckling reverse deformed with the second drive component.

In the ink-jet recording head of the second aspect, the beam member is provided with a beginning bend in advance so as to be concave in the ink droplet discharging direction. The first drive component bending the beam member to be convex in the ink droplet discharging direction, whereby the second drive component makes the beam member convex from concave in the ink droplet discharging direction, so even if there is deformation, there is no buckling reverse.

Due to this, it is provided with a beginning bend so as to be concave towards the discharging direction. The first drive component bends only the beam member so as to be convex in the discharging direction, and buckling reverse with deformation is started by the second drive component. A method where the ink droplet is made to disengage with inertia and eject from the nozzle is used so it is possible to stably control ejecting by the ON/OFF of the first drive component.

In the ink-jet recording head of the first or second aspect, the first drive component is a formed bending actuator connecting the beam member and electrostrictive element.

Due to this, large displacement can be obtained by use of the electrostrictive element and control of ejecting can be controlled with certainty.

In the ink-jet recording head of the first or second aspect, an electrode layer for driving the bending actuator doubles as the beam member.

Due to this, the structure of the ink-jet recording head becomes simplified whereby processing man-hours can be reduced.

What is claimed is:

1. An ink-jet recording head comprising:

a nozzle that ejects an ink droplet;

an ink flow path member that includes the nozzle;

a beam member connected to the ink flow path member or which includes the ink flow path member;

a first drive component connected with and set at the beam member and which bends the beam member and the ink flow path; and a second drive component that deforms the beam member and the ink flow path so as to become convex from concave in the ink droplet discharging direction, wherein the second drive component deforms the beam member so as to become convex from concave in the ink droplet discharging direction and the first drive component bends the beam member, whereby the beam member is not buckling reverse deformed with the second drive component and an ink droplet is not ejected.

2. The ink-jet recording head of claim 1, wherein the beam member is provided with a beginning bend in advance so as to be concave in the ink drop discharging direction, and the first drive component bends the beam member to be convex in the ink droplet discharging direction, whereby the beam member is not buckling reverse deformed even if the beam member is deformed from concave to convex in the ink droplet discharging direction with the second drive component.

3. The ink-jet recording head of claim 1, wherein the first drive component is a formed bending actuator connected with the beam member and an electrostrictive element.

4. The ink-jet recording element of claim 3, wherein an electrode layer for driving the bending actuator doubles as the beam member.

5. An ink-jet recording device comprising:

an ink-jet recording head; and a head supporting member that retains the ink-jet recording head, wherein the ink-jet recording head includes a nozzle that ejects an ink droplet, an ink flow path member that includes the nozzle, a beam member connected to the ink flow path member or which includes the ink flow path member, a first drive component connected with and set at the beam member and which bends the beam member and the ink flow path, and a second drive component that deforms the beam member and the ink flow path so as to become convex from concave in the ink droplet discharging direction, wherein the second drive component deforms the beam member so as to become convex from concave in the ink droplet discharging direction and the first drive component bends the beam member, whereby the beam member is not buckling reverse deformed with the second drive component and an ink droplet is not ejected.

6. The ink-jet recording device of claim 5, wherein the beam member is provided with a beginning bend in advance so as to be convex in the drop discharging direction, and the first drive component bends the beam member to be concave in the ink droplet discharging direction, whereby the beam member is not buckling reverse deformed even if the beam member is deformed from concave to convex in the ink droplet discharging direction with the second drive component.

7. The ink-jet recording device of claim 5, wherein the first drive component is a formed bending actuator connected with the beam member and an electrostrictive element.

8. The ink-jet recording device of claim 7, wherein an electrode layer for driving the bending actuator doubles as the beam member.

* * * * *